10/22/85 2 XR 4,548,609

United States Patent [19]

Schöne

[11] Patent Number: 4,548,609

[45] Date of Patent: Oct. 22, 1985

[54] METHOD FOR MARKING DEFECTS IN LEATHER

[75] Inventor: Alfred Schöne, Oberwil, Switzerland

[73] Assignee: Sandoz Ltd., Basel, Switzerland

[21] Appl. No.: 570,208

[22] Filed: Jan. 12, 1984

[30] Foreign Application Priority Data

Jan. 13, 1983 [DE] Fed. Rep. of Germany ..... 3300916

[51] Int. Cl.[4] ..... C14C 5/00

[52] U.S. Cl. ..... 8/94.21; 8/436; 427/157; 427/158

[58] Field of Search ..... 8/436, 94.21; 427/157, 427/158

[56] References Cited

U.S. PATENT DOCUMENTS

| | | | |
|---|---|---|---|
| 2,848,348 | 8/1958 | McCafferty | 427/157 |
| 2,856,311 | 10/1958 | Siegrist et al. | 427/158 |
| 2,876,130 | 3/1959 | Ciaccio | 427/158 |
| 3,242,177 | 3/1966 | Schellhammer et al. | 427/158 |
| 3,849,163 | 11/1974 | Siegrist et al. | 427/158 |

FOREIGN PATENT DOCUMENTS

| | | |
|---|---|---|
| 3019260 | 12/1981 | Fed. Rep. of Germany . |
| 898398 | 6/1962 | United Kingdom . |

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

Disclosed is a method for marking mineral tanned leather by treating the unfinished leather with an anionic aqueous dispersion of a fluorescent pigment. The marked leather can then be sorted by exposure to UV-radiation.

28 Claims, No Drawings

METHOD FOR MARKING DEFECTS IN LEATHER

The present invention relates to a method for marking leather defects to improve the sorting of leather.

As a natural product, leather can exhibit natural imperfections and defects. Modern processing in large vats ("hide processors"), particularly when these vessels are loaded to full capacity, frequently gives rise to defects where damage by abrasion has occurred. Such defects cannot be seen in the wet state, and only with difficulty in the dry undyed state but become visible after dyeing, with a negative effect on the value of the finished leather.

It is highly desirable to sort the leather at an early stage of its processing or finishing to avoid unnecessary production costs. Sorting of leather is generally carried out after tanning, in the wet state. Leather which is processed with an intermediate drying step is usually sorted in the crust state, i.e. the leather is fatliquored and dried. At present, evaluation of the degree of damage, and therefore of the uses to which the hide can be put, is still unsatisfactory, and this results in a high wastage rate in the production of finished leather goods and consequently increasing production costs.

It has now been found that defects, particularly abrasion damage, can be detected in mineral tanned leather in the wet as well as in the crust state when the leather is treated with an anionic dispersion of a fluorescent pigment.

Accordingly, the invention provides a method for marking mineral tanned leather comprising treating the unfinished leather with an anionic aqueous dispersion of a fluorescent pigment.

The fluorescent pigment builds up preferentially on the defects of the leather thus rendering them more strongly fluorescent. According to the invention, the treated leather can then be sorted by exposure to UV-radiation. The fact that the fluorescent pigments preferentially mark the defects is surprising since the treatment of leather with an anionic water-soluble fluorescent compound makes the whole leather surface uniformly fluorescent.

Preferably the entire surface of the hide or leather piece is treated with the fluorescent pigment, according to the invention.

Suitable pigments according to the invention are those fluorescent pigments which can be dispersed in water with an anionic dispersing agent. As will be appreciated, the expression "pigment" should also be understood to include optical brighteners which are insoluble or only slightly soluble in water. Preferred pigments are those which are fluorescent when irradiated at a wavelength from 315 to 380 μm.

Colourless pigments are particularly preferred, that is fluorescent compounds which appear colourless when viewed in white light of wavelengths entirely within the visible range. Examples of preferred fluorescent pigments include the following compounds of formulae I to IV:

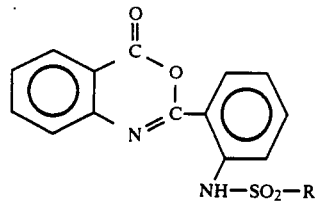
(I)

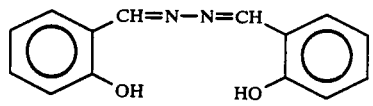
(II)

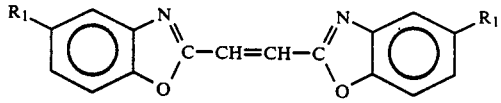
(III)

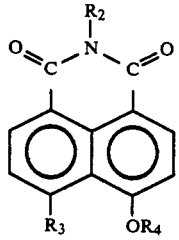
(IV)

wherein

R is aryl, preferably β-naphthyl, phenyl or phenyl substituted by up to three $C_{1-6}$alkyl $R_1$ is hydrogen or $C_{1-6}$alkyl $R_2$ and $R_4$, independently, are unsubstituted $C_{1-6}$alkyl or $C_{1-6}$alkyl substituted by up to two substituents selected from $C_{1-4}$alkoxy and halogen and $R_3$ is hydrogen or has independently one of the significances of $OR_4$ and their mixtures.

Any $C_{1-6}$alkyl may be straight chain or branched. $C_{1-6}$alkyl is preferably $C_{1-4}$alkyl, particularly methyl or ethyl. When $R_2$ or $R_4$ is substituted alkyl, it is preferably monosubstituted alkyl. Halogen is preferably chlorine or bromine. Any $C_{1-4}$alkoxy substituent is preferably methoxy or ethoxy.

According to the invention, the fluorescent pigments are used together with one or more dispersing agents, the ionicity of the resulting dispersion being anionic. Suitable dispersing agents include anionic dispersing agents or mixtures of anionic and non-ionic dispersing agents which do not possess an intrinsic fluorescence. Preferably the dispersing agents are colourless. Anionic and non-ionic dispersing agents are known compounds, e.g. as disclosed in Tenside, Textilhilfsmittel und Waschrohstoffe, K. Lindner, (1964). Preferred anionic dispersing agents include sulphates, e.g. fatty acid sulphates, fatty acid ester sulphates, fatty alkyl sulphates, sulphated polyglycol ethers, sulphated alkoxylated amines etc., and sulphonates e.g. alkyl sulphonates, sulphonated fatty acids, fatty acid esters or fatty acid amides, aromatic sulphonates such as alkyl $C_{1-12}$ naphthyl sulphonates or the condensation products of aromatic sulphonates with formaldehyde, sulphonated oils, or lignin sulphonates. When the anionic dispersing agents are present in the salt form, they are preferably in form of an alkali metal salt or an ammonium salt, particularly in the sodium salt form. Among the preferred anionic dispersing agents, the sulphonates are especially preferred, particularly the lignin sulphonates and the aromatic sulphonates, preferably the condensation products of naphthalene sulphonic acids with formaldehyde, e.g. dinaphthylmethane disulphonic acid sodium salts.

Suitable non-ionic dispersing agents include alkyl $C_{1-18}$-phenyl polyglycol ethers, particularly $C_{1-10}$alkyl phenols ethoxylated with 5 to 50 ethylene oxide units. The non-ionic dispersing agents being used in admixture with one or more anionic dispersing agents, the weight ratio of non-ionic to the anionic dispersing agent is such that the resulting mixture has a predominantly anionic character.

Preferably the fluorescent pigment is used with an anionic dispersing agent or a mixture of such, in the absence of non-ionic dispersing agent.

The amount of fluorescent pigment used for marking the leather defects may vary depending on the fluorescence properties of the pigment and on the processing stage at which the marking and sorting are carried out. In general, good results are obtained when the fluorescent pigment is used in an amount from 0.001 to 0.05%, preferably 0.01 to 0.05% by weight based on the pelt weight, or in an amount of from 0.01 to 0.25%, preferably 0.1 to 0.25% by weight based on the shaved weight.

The amount of dispersing agent may vary depending on the dispersability of the pigments in water. Preferably the dispersing agents (whether they are anionic or a mixture of anionic and non-ionic dispersing agents) are used in a weight ratio to the fluorescent pigments of from 0.5:10 to 6:10, preferably 0.5:10 to 4:10.

The marking treatment with the dispersed fluorescent pigment may be carried out at any stage of the leather production, the leather substrate having been at least mineral tanned, i.e. tanned with mineral salts such as aluminium, chrome, iron and zirconium salts. Preferably the leather marking and leather sorting are effected after tanning and before dyeing. Leather of various origins may be treated according to the invention, e.g. leather obtained from cattle, calf, goat, kid, sheep, lamb or buffalo hides and skins.

According to the invention, the marking treatment may be carried out directly after mineral tanning, by adding the fluorescent pigment dispersion to the tanning bath after exhaustion of the tanning bath, or by applying to the substrate from a freshly prepared bath. The treatment may be effected according to known methods as used in leather processing. Preferably the treatment with the dispersed fluorescent pigment is performed at a temperature from 20° to 45°, preferably from 20° to 35° C., over a period of from 10 to 30 minutes, particularly 15 to 20 minutes. After the treatment, the leather is preferably sammed.

The sorting of the marked leather may be carried out directly after the samming or at a later step of the leather processing. However, if the sorting of the treated leather is carried out at a later stage, care should be taken that it takes place before the fluorescent pigment can be washed off.

When the leather sorting is carried out on crust leather, it is recommended to treat the substrate with the dispersed fluorescent pigment during the wet processing before the intermediate drying step, preferably before the neutralisation step. The treatment conditions are analogous to those indicated above.

After the leather has been sorted, the selected leather may be further finished. The fluorescent pigment can easily be removed from the leather, e.g., during the subsequent wet finishing such as dyeing, fatliquoring and the like or by washing or rinsing according to known leather processing or finishing methods. The resulting finished leather is substantially free of undesired fluorescence. However, if some fluorescence effect is desired on the finished leather, it is recommended to treat the substrate, with higher amounts of dispersed fluorescent pigments than those indicated above.

According to the invention an efficient leather sorting can be achieved at an early stage in the leather production. It enables the manufacturer to obtain not only savings in time and production costs but also finished leather with a higher quality and a greater uniformity. A further advantage of the invention is that the leather sorting can be performed mechanically, for example by a scanning machine measures the degree of fluorescence at each point of the surface.

The following Examples further serve to illustrate the invention. In the Examples all parts and percentages are by weight and all temperatures in degrees Centigrade.

EXAMPLE 1

Cattle hides are tanned according to known methods for 8 to 10 hours at 28°–30° with a chrome tanning agent, for example Baychrom A (Trade Mark, Bayer, West Germany). After exhaustion of the tanning bath, an anionic dispersion containing 35% of the compound of formula II and 20% of a commercially available anionic dispersing agent based on a condensation product of a naphthalene sulphonic acid with formaldehyde, is added to the bath at a ratio of 0.02% of fluorescent pigment based on the pelt weight and the whole is agitated for 15 to 20 minutes. The leather is then removed from the bath and, after ageing on a horse, it is sammed. The resulting leather is subsequently exposed to UV-radiation. All the defects of the treated leather are visible and the leather can be sorted accordingly.

By following the same procedure as indicated above but replacing the compound of formula II by a compound of formula I, III or IV, for example a compound of formula I wherein R is naphthyl, the same good results are obtained.

EXAMPLE 2

Undyed wet-blue leather is rinsed or washed according to known methods and then treated at 35° for 15 to 20 minutes with a freshly prepared bath containing approx. 220% water, 0.05% of a fluorescent pigment of formula I, II or III based on the shaved weight and 25% of a commercially available anionic dispersing agent (as disclosed in Example 1) based on the weight of the pigment. In the formula I, R is preferably 2, 4, 6-trimethylphenyl or $\beta$-naphthyl and in formula III $R_1$ is preferably methyl.

Subsequently, the leather is neutralised, retanned and fatliquored. After drying, the defects of the resulting leather are detectable by exposure to a UV-source.

What is claimed is:

1. A method for marking a defect in leather which comprises applying to the entire surface of mineral tanned leather containing such a defect, prior to completion of the finishing of said leather, an anionic aqueous dispersion of a fluorescent organic pigment.

2. A method according to claim 1 wherein the fluorescent pigment is a compound of formula I, II, III or IV (I)

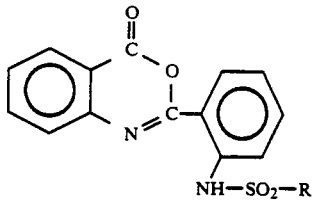

(II)

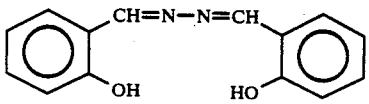

(III)

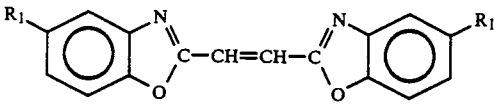

(IV)

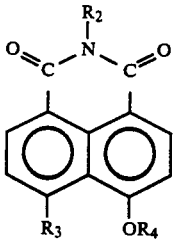

wherein

R is aryl, $R_1$ is hydrogen or $C_{1-6}$alkyl $R_2$ and $R_4$, independently, are unsubstituted $C_{1-6}$alkyl or $C_{1-6}$alkyl substituted by up to two substituents selected from $C_{1-4}$alkoxy and halogen and $R_3$ is hydrogen or has independently one of the significances of $OR_4$ and their mixtures.

3. A method according to claim 2, wherein the fluorescent pigment is a compound of formula I in which R is 2,4,6-trimethylphenyl.

4. A method according to claim 2, wherein the fluorescent pigment is a compound of formula III in which $R_1$ is methyl.

5. A method according to claim 2 wherein, in formula (I), R is β-naphthyl, phenyl or phenyl substituted by up to three $C_{1-6}$alkyl groups.

6. A method according to claim 1, wherein the dispersion comprises an anionic dispersing agent which is selected from the group consisting of alkyl sulphonates, sulphonated fatty acids, sulphonated fatty acid esters, sulphonated fatty acid amides, aromatic sulphonates and their condensation products with formaldehyde, sulphonated oils and lignin sulphonates.

7. A method according to claim 1, wherein the dispersion comprises as an anionic dispersing agent a lignin sulphonate or a condensation product of a naphthalene sulphonic acid with formaldehyde.

8. A method according to claim 1, wherein in the dispersion the weight ratio of the total dispersing agent to the fluorescent pigment is from 0.5:10 to 6:10.

9. A method according to claim 1, wherein the treatment with the anionic aqueous dispersion of a fluorescent pigment is carried out directly after mineral tanning.

10. A method according to claim 1 wherein the treatment with the anionic aqueous dispersion of a fluorescent pigment is carried out before the neutralisation step in the processing of crust leather.

11. A method according to claim 1 wherein the fluorescent pigment builds up preferentially on the defect of the leather and renders it more strongly fluorescent than the non-defective portions of the leather.

12. A method for sorting leather which comprises exposing to UV radiation a mineral tanned leather marked by a method according to claim 1.

13. A method according to claim 12 wherein the fluorescent pigment is used in an amount of from 0.001 to 0.05%, by weight, based on the pelt weight or 0.01 to 0.25%, by weight, based on the shaved weight of the leather.

14. A method according to claim 13, wherein the fluorescent pigment is dispersed with one or more anionic dispersing agents or a mixture of anionic and nonionic dispersing agents, the ionicity of the resulting dispersion being anionic.

15. A method according to claim 12 which is carried out before dyeing the leather.

16. A method according to claim 14 wherein the fluorescent pigment is a compound of formula I, II, III or IV (I)

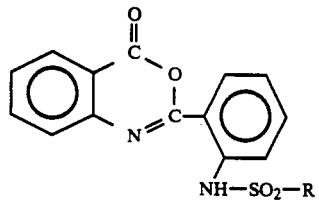

(II)

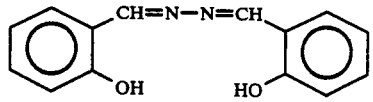

(III)

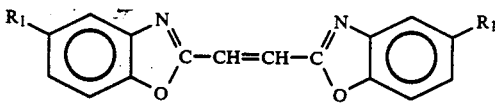

(IV)

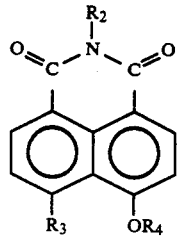

wherein

R is aryl, $R_1$ is hydrogen or $C_{1-6}$alkyl, $R_2$ and $R_4$, independently, are unsubstituted $C_{1-6}$alkyl or $C_{1-6}$alkyl substituted by up to two substituents selected from $C_{1-4}$alkoxy and halogen, and $R_3$ is hydrogen or has independently one of the significances of $OR_4$, and their mixtures.

17. A method according to claim 16 wherein, in formula (I), R is β-naphthyl, phenyl or phenyl substituted by up to three $C_{1-6}$alkyl groups.

18. A method according to claim 14 wherein the treatment with the anionic aqueous dispersion of a fluorescent pigment is carried out directly after mineral tanning.

19. A method according to claim 1 wherein the pigment is fluorescent when irradiated at a wavelength of 315 to 380 μm.

20. A method according to claim 20 wherein the pigment is fluorescent when irradiated at a wavelength of 315 to 380 μm.

21. A method according to claim 1 wherein the fluorescent pigment is used in an amount of from 0.001 to 0.05%, by weight, based on the pelt weight or 0.01 to 0.25%, by weight, based on the shaved weight of the leather.

22. A method according to claim 1, wherein the fluorescent pigment is dispersed with one or more anionic dispersing agents or a mixture of anionic and non-ionic dispersing agents, the ionicity of the resulting dispersion being anionic.

23. A method for sorting mineral tanned leather containing a defect which comprises applying to such leather an anionic aqueous dispersion of a fluorescent organic pigment whereby the pigment builds up preferentially on the defect in the leather and renders it more strongly fluorescent than the non-defective portions of the leather, and exposing the thus-treated leather to UV radiation.

24. A method according to claim 23, wherein the pigment is fluorescent when irradiated at a wavelength from 315 to 380 μm.

25. A method according to claim 23, wherein the fluorescent pigment is dispersed with one or more anionic dispersing agents or a mixture of anionic and non-ionic dispersing agents, the ionicity of the resulting dispersion being anionic.

26. A method according to claim 25 wherein the non-ionic dispersing agent is an alkyl $C_{1-18}$phenyl polyglycol ether.

27. A method according to claim 23 wherein the fluorescent pigment is used in an amount of from 0.001 to 0.05%, by weight, based on the pelt weight or 0.01 to 0.25%, by weight, based on the shaved weight of the leather.

28. A method according to claim 23 wherein the fluorescent pigment is a compound of formula I, II, III or IV (I)

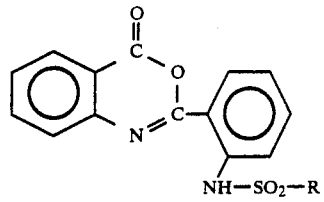

(II)

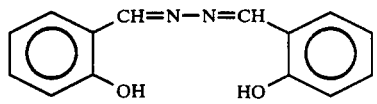

(III)

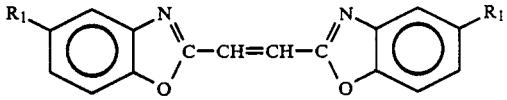

(IV)

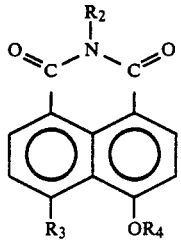

wherein

R is β-naphthyl, phenyl or phenyl substituted by up to three $C_{1-6}$alkyl groups, $R_1$ is hydrogen or $C_{1-6}$alkyl $R_2$ and $R_4$, independently, are unsubstituted $C_{1-6}$alkyl or $C_{1-6}$alkyl substituted by up to two substitutents selected from $C_{1-4}$alkoxy and halogen and $R_3$ is hydrogen or has independently one of the significances of $OR_4$ and their mixtures.

* * * * *